US005783905A

United States Patent [19]

Greschner et al.

[11] Patent Number: 5,783,905

[45] Date of Patent: Jul. 21, 1998

[54] FIELD EMISSION DEVICE WITH SERIES RESISTOR TIP AND METHOD OF MANUFACTURING

[75] Inventors: Johann Greschner, Pliezhausen, Germany; Peter Pleshko, Staatsburg, N.Y.; Gerhard Schmid, Leinfelden-Echterdingen, Germany

[73] Assignee: International Business Machines Corporation, Armonk, N.Y.

[21] Appl. No.: 774,853

[22] Filed: Dec. 27, 1996

Related U.S. Application Data

[63] Continuation of Ser. No. 459,070, Jun. 2, 1995, abandoned.

[30] Foreign Application Priority Data

Aug. 31, 1994 [EP] European Pat. Off. ..... 94 113 601

[51] Int. Cl.[6] ..... H01J 1/30

[52] U.S. Cl. ..... 313/497; 313/336

[58] Field of Search ..... 313/495, 496, 313/497, 309, 336, 351

[56] References Cited

U.S. PATENT DOCUMENTS

| | | | |
|---|---|---|---|
| 4,168,213 | 9/1979 | Hoeberechts | 204/15 |
| 5,038,070 | 8/1991 | Bardai et al. | 313/309 |
| 5,063,327 | 11/1991 | Brodie et al. | 313/495 |
| 5,126,287 | 6/1992 | Jones | 445/50 |
| 5,141,459 | 8/1992 | Zimmerman | 445/50 |
| 5,223,766 | 6/1993 | Nakayama et al. | 313/495 |
| 5,371,431 | 12/1994 | Jones et al. | 313/309 |
| 5,451,830 | 9/1995 | Huang | 313/309 |
| 5,469,014 | 11/1995 | Itoh et al. | 313/309 |

OTHER PUBLICATIONS

S. Zimmerman et al, A Fabrication Method for the Integration of Vacuum Microelectronic Devices, IEEE Transactions on Electronic Device vol. 38 No. 10 pp. 2294–2303, Oct. 1991.

E. Adler et al., Demonstration of Low Voltage Field Emission IEEE Transactions on Electronic Devices vol. 38, No. 10 pp. 2304–2308, Oct. 1991.

C.A. Spindt Journal of Applied Physics, vol. 38 No. 7 A Thin Film Field–Emission Cathode, pp. 3504–3505, 1968 (no month).

A. Ghis, Sealed Vacuum Devices: Fluoresced Microtip Displays, IEEE Transactions on Electronic Devices vol. 38 No. 10 pp. 2320–2322, Oct. 1991.

T. Asano, Simulation of Geometrical Changes Effects or Electrical Characteristics of Micrometer Size Vacuum Triode with Field Emitters IEEE Transactions vol. 38 No. 10 pp. 2292–2394, Oct. 1991.

*Primary Examiner*—Sandra L. O'Shea
*Assistant Examiner*—Michael Day
*Attorney, Agent, or Firm*—David Aker

[57] ABSTRACT

The invention generally relates to the technical field of devices using the effect to emit electrons out of a solid into vacuum due to high electric field strength. Such devices are usually called field emission devices. The invention relates more specifically to the structure of a field emission device, to the method of fabricating a field emission device, and to the use of a multitude of field emission devices in the technical field of flat panel displays. The inventive structure of a field emission device (15) comprises an individual series resistor for each electron emitting tip (1), wherein the series resistor is formed by the tip (1) itself. The tip (1) comprises a body (9) of a first material with high resistivity and an at least partial coating (7) of a second material with low work function, wherein the body (9) of the first material forms the series resistor and the coating (7) of the second material provides for electron emission. The method for fabricating a field emission device (15) uses depositing and sacrificial layer etch back techniques to provide easy and precise control of tip height and shape and also easy and precise control of the tip-to-gate distance and geometry.

8 Claims, 4 Drawing Sheets

FIELD EMISSION DEVICE WITH SERIES RESISTOR TIP AND METHOD OF MANUFACTURING

This application is a continuation of application Ser. No. 08/459,070, filed Jun. 2, 1995 and now abandoned.

TECHNICAL FIELD

The present invention relates to the technical field of devices using the effect to emit electrons out of a solid into vacuum due to high electric field strength. Such devices are usually called "field emission devices". The invention relates to the structure of a field emission device, to the method of fabricating a field emission device, and, more specifically, to the use of a multitude of field emission devices in the technical field of flat panel displays.

BACKGROUND ART

Field emission devices can be used to replace conventional thermal emission devices as electron sources for e.g. scanning electron microscopes, high performance and high frequency vacuum tubes, and, more general, for vacuum microelectronic devices.

In recent years there has been a growing interest in using miniaturized field emission devices in the technical field of flat panel displays. A miniaturized device which uses a multitude of tips or microtips for simultaneous electron emission and which achieves high electric field strengths, by applying fairly low voltages due to tip-to-electrode distances in the micron range was first proposed by C. A. Spindt in Journal of Applied Physics, Vol. 39 (1968), No. 7, pages 3504–3505. Several publications by the same author and by others followed over the last twenty years. A comprehensive review is given in IEEE Transactions on Electron Devices, Vol. 38 (1991), No. 10, pages 2289–2400.

A typical field emission device comprises a conductive tip placed on a conductive electrode which usually forms the cathode electrode. The tip end is surrounded by a gate electrode. An appropriate voltage is applied between the cathode and the gate electrode to emit electrons into the vacuum. For the application of these field emission devices in the technical field of flat panel displays the tip and gate arrangement is encapsulated by an upper and lower glass plate. The upper glass plate contains the anode electrode and a phosphorous layer. An applied voltage between the cathode and the anode electrode accelerates the electrons emitted by the tips towards the phosphorous layer which emits visible light that is usable in a display device. Gate and cathode electrodes are typically arranged in orthogonal stripes which allows matrix addressing of the electron emitting tips. Usually, an array of typically 1,000 tips forms one pixel.

One major problem of the application of field emission devices as light emitting sources in flat panel displays is the non-uniformity in the emission characteristics of the multitude of tips. The reliability of tip emission depends on several factors like applied voltage, cleanliness of the tips, vacuum quality, geometry, materials, etc. The field emission is extremely sensitive to the above cited factors. Despite the fact, that about 1,000 tips were electrically driven in parallel to form one pixel, it was not possible to achieve stable and uniformly illuminated pixels. Typically a few of the tips operating at a high current level burst and caused short circuits between the cathode and the gate electrode. As a consequence, this short circuit disables a complete cathode and gate electrode stripe.

In A. Ghis et al: "Field Vacuum Devices: Fluorescent Microtip Displays", IEEE Transactions on Electron Devices, Vol. 38 (1991), No. 10, pages 2320–2322, which can be regarded as the nearest prior art document according to the structure of a field emission device of the present invention, a polysilicon resistive layer underlying a multitude of tips was introduced by which the current flowing through the tips was limited. FIG. 1 shows an electron emitting tip 1 which is connected via a resistive layer 2 to a conductive layer 3 which is the cathode electrode. This arrangement is built on a first glass substrate 4. The third conductive layer 5, which is the gate electrode, is separated from the first conductive layer 2 by a dielectric layer 6. The first conductive layer 2 acts as a series resistant layer for each tip 1.

Each pixel was divided in 50 groups of tips, each group consists of 36 tips; Each tip within a group is connected via a common polysilicon resistive layer to the cathode electrode which is meshed. Therefore, there is no cathode electrode metallization directly underneath the tips. Therefore, in case of a short circuit between one tip and its respective gate electrode the whole pixel (made of 50 groups) will not be affected. However, it is still disadvantageous that in case of a failure of one tip the respective complete group of tips will fail. It is also disadvantageous that there is a considerable voltage drop within one group of tips caused by the various distances between individual tips and the cathode electrode which leads to different values of the series resistance for each individual tip. This voltage drop requires a considerably higher driving voltage and also power consumption and results in less tip emission current. Furthermore, the voltage drop causes a non-uniform emission within one group of tips and therefore causes a non-uniformity in pixel brightness.

The method for fabricating of field emission devices has a significant influence on the performance of field emission devices in each of the applications of field emission devices mentioned above. In T. Asano: "Simulation of Geometrical Change Effects on Electrical Characteristics of Micrometer-Size Vacuum Triode with Field Emitters", IEEE Transactions on Electron Devices, Vol. 38 (1991), No. 10, pages 2392–2394, a simulation of the change in electrical characteristic of a field emission device due to changes in physical dimensions has been described. A major result of this simulation is that the deviation of the gate opening size more strongly effects the field strength near the tip than a misalignment of tip and gate aperture. Furthermore, the simulation shows that this effect is more pronounced when the gate voltage is low. These results show the significance of a well controlled geometry of the field emission device and therefore the impact of an appropriate fabrication method.

In U.S. Pat. No. 4,168,213 (Hoebrechts), U.S. Pat. No. 5,126,287 (Jones) methods for fabricating field emission devices are described that use partially self aligned processing techniques. In the U.S. Pat. No. 5,141,459 (Zimmerman), which can be regarded as the nearest prior art document according to the fabrication method of the present invention, a fabricating process for field emission cathodes using conformal layer deposition on a sacrificial dielectric layer is described. Since the diameter of the gate electrode aperture is a significant parameter for the emission efficiency, and therefore should be minimized to achieve high emission efficiency, it is disadvantageous from the described fabrication process that a small gate aperture diameter can only be achieved by a high resolution lithographic, depositing, and etching technology, e.g. to realize submicron gate aperture diameter requires submicron lithographic, depositing, and etching technology. These high technology requirements are further more disadvantageous for the application of field emission devices in the technical field of flat panel displays with their typically large substrate dimensions.

Some of the prior art methods for fabricating field emission devices are using certain lithographic, depositing, and etching processes as normally used in the technical field of semiconductor process technology. In S. M. Sze: "VLSI Technology", McGraw-Hill, New York, 1988, theoretical and practical aspects of the VLSI (Very Large Scale Integration) technology, as the present standard for semiconductor process technology are described.

OBJECTS OF THE INVENTION

It is an object of the invention to provide a field emission device with reliable and reproducible performance concerning the emission efficiency even in the case of geometrical variation of the tip-gate electrode arrangement.

It is another object of the invention to provide an electron emission device with a high uniformity in emission efficiency from tip to tip.

Further it is an object of the invention to provide a method for fabricating with relaxed process requirements for a given gate aperture diameter and a method for fabricating to allow the reliable control of the tip to gate distance.

SUMMARY OF THE INVENTION

In accordance with the present invention a field emission device is provided with a series resistor formed by the tip so that it can be directly connected to the supply electrode, e.g. the cathode electrode. As no additional resistive layer is required the fabricating process for such a field emission device is easier, more reliable, and cheaper. In the case of simultaneous use of a multitude of tips, the tip-individual series resistor offers higher tip to tip homogeneity of electron emission, since there is no voltage drop within a group of tips. Furthermore, the "no voltage drop" has the advantage of a lower supply voltage and therefore less power consumption. The less supply voltage also has the advantage to use a more convenient control electronics. Furthermore, it is advantageous from the tip individual series resistor that in the case of a failure, e.g. a short circuit between one tip and its related gate electrode, just this tip fails and all surrounding tips remain unchanged in performance. This offers a high homogeneity and a high overall emission efficiency even in the case of a failure.

In one embodiment of the invention, the tip comprises a body of a first material forming the series resistor and a coating of a second material providing for electron emission. This separation of the tip in two components allows more flexibility in view to the optimization of both materials with respect to their objects. Furthermore, a particularly thin coating of the tip body with the relatively expensive electron emission material offers the possibility of cost reduction during the fabrication process.

In a further embodiment of the invention a high resistivity material is used for the body of the tip and a material with a low work function is used for the coating of the tip. This is advantageous since the high resistivity material allows the realization of a small tip geometry with significant resistance value. The low work function material is also advantageous since it allows a high emission efficiency already at relatively low voltages.

In a further embodiment of the invention the high resistivity material is a amorphous or polycrystalline silicon, which is no- or low-doped and the low work function material is wolfram (W) or molybdenum (Mo). The use of silicon for the high resistivity material is advantageous, because the resistivity of silicon can be easily modified, either at the time of deposition of the silicon film or after deposition of the silicon film by using diffusion or ion implantation methods. Furthermore, silicon is a very usual material, available in very high purity, relatively low in cost, and can be deposited by various depositing methods. The use of wolfram or molybden as a low work function material is advantageous, because those material are very usual for electron emission devices and can be deposited by using standard depositing techniques and equipment.

In a further embodiment of the invention, the tip is low-ohmic or directly connected to a first electrode, which is usually the cathode electrode, and which is formed on a first substrate. This is advantageous since it offers a very low or even no voltage drop between the tip and the cathode electrode which leads to a high emission efficiency.

In a further embodiment of the invention, the tip is centered in relation to a particularly circular gate aperture that is forming a second electrode, the gate electrode. This gate electrode allows advantageously easy and precise emission control. Furthermore, the emission and the acceleration of the emitted electrons can be controlled separately.

In a further embodiment of the invention, the tip is opposed to a third electrode on a second substrate which comprises also a photon emitting layer. This third electrode is used for the acceleration of the emitted electrons and allows easy and precise control for the energy of electrons when arriving at the second substrate. The photo emitting layer allows advantageously the use of field emission devices as light emitting sources.

Since the invention proposes the use of field emission devices in flat panel displays, it is advantageous that field emission devices offer the possibility of realizing light emitting sources with high brightness, high contrast, low power consumption, and easy fabricating processes using standard semiconductor technology leading to a flexible and relatively cheap production method.

The use of a multitude of field emission devices in the field of flat panel displays with a pixel-oriented organization offers the advantage of easy adaption of the flat panel device to applications that require low or high brightness, low or high resolution, low or high contrast, and small or large display size.

The use of a multitude of field emission devices in the field of flat panel displays with a pixel-triple-organization offers the advantage of the possible realization of full color displays.

The fabrication method as disclosed in the present application offers the advantage of relaxed lithographic, etching, and depositing process requirements. Furthermore, this offers a higher flexibility concerning the selection of process technology and is in particular advantageous in view of large-size flat panel displays. It is also advantageous, that the disclosed fabrication method offers the possibility of easy and precise control of the tip-to-gate distance. Using the relaxed lithographic, etching, and depositing technology requirements this tip-to-gate distance can be well controlled even in the submicron region. A small tip-to-gate distance offers a high field emission efficiency at lower voltages and less power consumption which is in particular advantageous for battery powered arrangements as flat panel displays for mobile computers. The low supply voltage is furthermore advantageous because it allows a more convenient control electronics. It is a further advantage of the disclosed fabrication method that it provides a complete cathode, electron emission tip, and gate electrode. Furthermore, it is advantageous that the tip height and shape can be controlled easily.

In a further elaborated method of the invention the molds are created by using a patterned photoresistive layer in combination with an appropriate wet or dry etching process and a reliable etch stop. Standard semiconductor technology offers a plurality of processes forming molds having the desired and well controlled tapering shape. Furthermore, the separation in first and second dielectric layer as described in the fabrication method is advantageous for providing a reliable etch stop on the first dielectric layer when creating the molds for the tips in the second dielectric layer. The accuracy which is defined by this etch stop determines the tip-to-gate electrode distance and the gate opening size which is one of the most important factors for electron emission efficiency and reliability. Furthermore, the separation in first and second conductive layer as described in the method for fabricating is advantageous since it allows the separate optimization of the first conductive layer for adapted resistivity and also the optimization of the second conductive layer for low-ohmic electrode cathode connection. Furthermore, it is advantageous that the coating with the third conductive layer simultaneously provides gate electrode metallization and tip coating without an additional patterning process.

In further elaboration of the method for fabrication the combination of $SiO_2$- and $Si_3N_4$-layers offers the possibility of selective etching with a high selectivity and a reliable etch stop. For the use of a polymer as well as for substrates or dielectric layer it is advantageous that the polymer can be removed by laser irradiation or can be dissolved chemically.

In addition the usage of semiconductor process technology offers high volume production, low cost, high precision and high reliability.

Due to the disclosed method for fabricating electron emission devices the tip height and radius is extremely uniform. The tip-to-gate electrode distance can easily be controlled down to submicron dimensions which allows field emission at low supply voltages. This not only leads to a lower power consumption which is an important fact for battery recharge cycles in portable display systems but also allows the use of a more convenient electronic control circuit. The disclosed method for fabrication allows a high degree of freedom in the choice of the critical materials like tip emitter metal and substrate sizes.

DESCRIPTION OF A PREFERRED EMBODIMENT

One preferred embodiment of a field emission device and a preferred method for fabricating a field emission device according to the present invention will be described with reference to the accompanying drawings.

Figure 1:
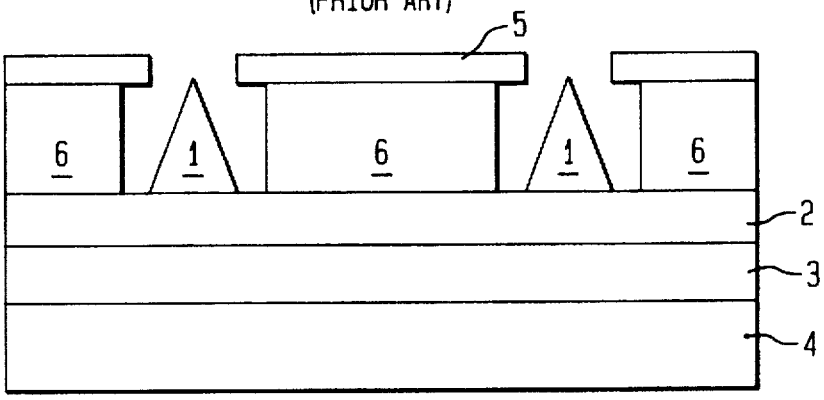
FIG. 1 (PRIOR ART)
FIG. 1 shows the structure of electron emission devices as known from the prior art.
Figure 2:
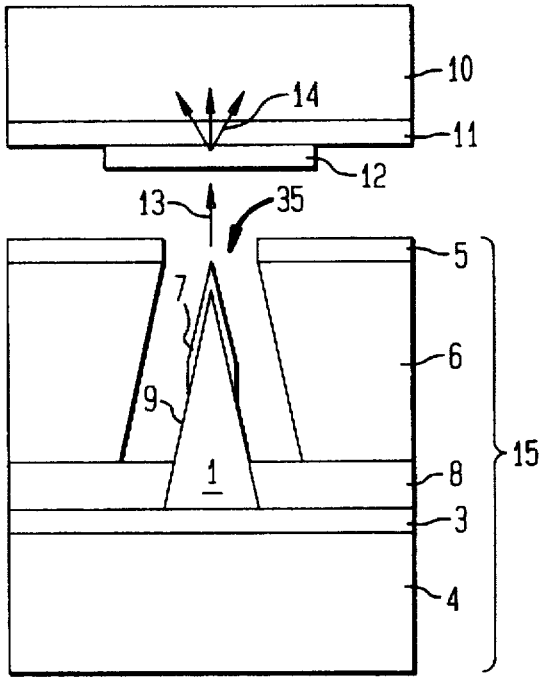
FIG. 2 shows a preferred embodiment of the invention as far as related to the structure of the field emission device.

The FIG. 2 shows a cross-section of one preferred tip structure as disclosed in the present invention. The tip 1 itself comprises the series resistor and the tip body 9 is made of polysilicon. The tip body 9 also can be made of another material that offers sufficient resistivity, as for example semiconductor materials like germanium or gallium arsenide. Furthermore, the tip body 9 can be made of a dielectric material which is covered with a resistive layer.

The tip body 9 is coated with a conductive material 7 offering low work function. The tip 1 is low-ohmic connected to a conductive layer 3, which is the cathode electrode. This cathode electrode 3 is formed by a conductive coating on a first glass substrate 4. The tip 1 is near to the base region surrounded by a first dielectric layer 8. This first dielectric layer 8 consists preferably of $Si_3N_4$. In the higher region the tip is surrounded, preferably circular surrounded, by a conductive gate electrode 5. The gate electrode 5 is separated from the first dielectric layer 8 by a second dielectric layer 6. The second dielectric layer 6 may be different from the first dielectric layer 8, preferably second dielectric layer 6 is made of $SiO_2$ and is thicker than the first dielectric layer 8.

For the use of a electron emission device in the field of flat panel displays a second glass substrate 10 is located opposite to the first glass substrate 4 and opposite to the tip 1. This second glass substrate 10 is covered with a transparent conductive electrode 11, as for example indium-tin oxide (ITO), which forms the anode electrode. This anode electrode 11 is at least partially covered with a phosphorous layer 12. The first glass substrate 4 and the second glass substrate 10 are hermetically bonded together and the intermediate space is evacuated. The distance between the tip 1 and the phosphorous layer 12 is typically between a few tenth of millimeter to few millimeters.

Due to a voltage between the gate electrode 5 and the cathode electrode 3, to which the tip 1 is connected, electrons emit from the tip 1 and are accelerated 13 in direction to the anode electrode 11 due to an applied voltage between the anode electrode 11 and the cathode electrode 3. When the accelerated electrons 13 arrive at the phosphorous layer 12, the phosphorous layer emits photons 14 with a wave length according to the composition of the phosphorous layer.

Figure 3A:
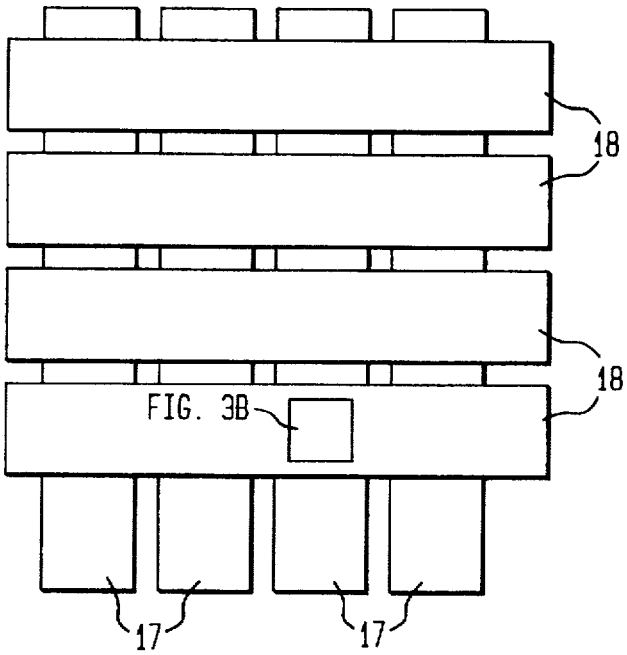
FIG. 3A shows an array of 4×4 groups, each group comprising a multitude of field emission devices.
Figure 3B:
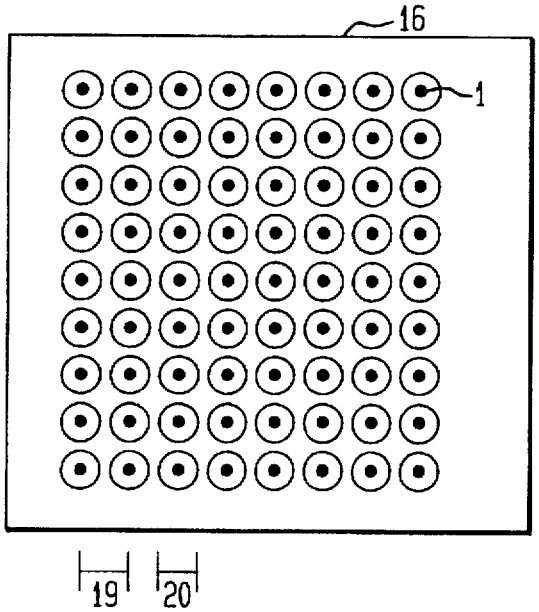
FIG. 3B shows an enlargement of FIG. 3A; multitude of field emission devices.

The FIG. 3A shows a 4×4 matrix of groups of tips 1. Such a group 16 of tips 1 is shown in the enlargement of FIG. 3B. Each group 16 comprises a multitude of tips 1 as shown in the enlargement of FIG. 3B. For the use of electron emission devices in the technical field of flat panel displays at least one of these groups 16 may act as a pixel. For the possibility to address each pixel separately, the gate electrode and the cathode electrode are organized in cathode electrode stripes 17 and gate electrode stripes 18. The stripes have a typical width of 300 μm and a typical spacing of 15 to 25 μm. The dielectric layer 6, which has a thickness of typically a few tenth of microns to few microns, between the cathode and the gate electrode stripes 17 and 18 is not shown in FIG. 3A. The typical dimensions of the tip organization within a group of tips 16, as shown in FIG. 3B, are ten micron for the center to center distance 19 of two tips and gate electrode hole diameters 20 of about 1 μm. The tip radius goes down to less than 50 μm.

Figure 4A:
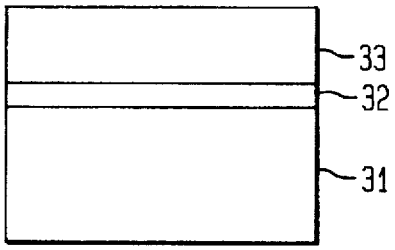
FIG. 4A to FIG. 4L show a preferred embodiment of the invention according to the method for fabricating field emission devices.
Figure 4B:
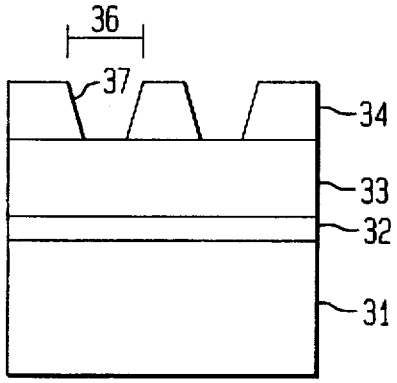

The FIGS. 4A–4L show a process sequence as a preferred embodiment of the method for fabricating field emission devices as disclosed in the present invention. In FIG. 4A a first substrate 31, which is a sacrificial substrate, is coated with a first layer 32 of $Si_3N_4$ and subsequently with a second layer 33 of $SiO_2$. The sacrificial substrate 31 could be for example a plate of relatively cheap polysilicon, typically used for making solar cells. The first layer 32 of $Si_3N_4$ may not be required at all depending on the material of the sacrificial substrate 31. Since all following processes may be low temperature processes with process temperatures of about or less than 300° C., the sacrificial substrate 31 could also be for example a glass plate, where instead of the first layer of $Si_3N_4$ 32 a polymer release layer is applied, which could be removed later on by laser irradiation through the glass plate. The sacrificial substrate 31 could also be of a polymer and dissolved later on chemically. On top of the second layer 33 of $SiO_2$ a photoresistive layer 34 is applied, optically exposed, and developed as shown in FIG. 4B. Since the critical dimension of the gate hole 35 of about one micron is in the disclosed concept at the bottom of the $SiO_2$ layer, the dimension 36 which has to be exposed in the resist depends on the desired slope angle 37, but will be in any case larger than the dimension of the gate hole 35 at the bottom of the second layer 33 of $SiO_2$. Preferably, the thickness of the photoresistive layer 34 is in the same range as the thickness of the second layer 33 of $SiO_2$.

Figure 4C:
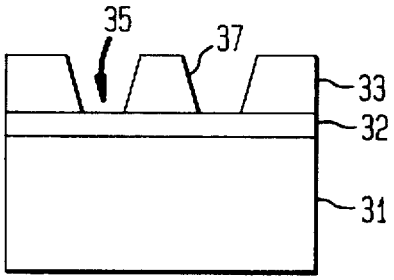

As shown in FIG. 4C the slope angle 37 achieved in the photoresistive layer profile will be transferred by an adequately chosen etch process, preferably a RIE (reactive ion etching) process, about 1:1 into the second layer 33 of $SiO_2$. The slope angle 37 of the photoresistive layer profile depends on the chosen lithographic method. Furthermore, the slope angle 37 can be adjusted by using an appropriate hard bake process and by an appropriate selection of photoresistive type and thickness. The RIE step to etch the second layer 33 of $SiO_2$ can be a usual $CF_4$ process. To allow an overetch it is important that the first layer 32 underneath the second layer 33 has a lower etch rate. The most important purpose of the first layer 32, which is between the second layer 33 of $SiO_2$ and the sacrificial substrate 31, is to act as an etch-stop for the RIE step. The accuracy, which is defined by this etch-stop, defines later on the tip to gate electrode distance.

Figure 4D:
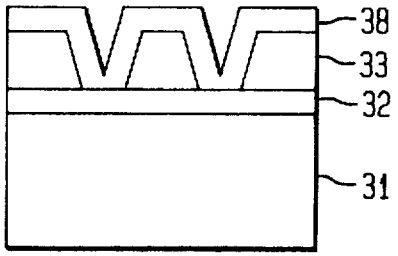

As shown in FIG. 4D a third layer 38 of $Si_3N_4$ is deposited on the surface, using physical or chemical depositing techniques, preferably a PECVD (plasma enhanced chemical vapor deposition) method. By using a non-conformal deposition technique less material is deposited at the sidewalls of the molds and at the bottom of the molds than at the top surface of the second layer 33 of $SiO_2$. Preferably $Si_3N_4$ can be used in this process step; it can be removed chemically later on with high selectivity against the second layer 33 of $SiO_2$ and it acts furthermore as an etch stop in the later chemical mechanical polishing step.

The molds are now filled and the surface is coated by a deposition process step, preferably a PECVD process step, depositing intrinsic or low doped polysilicon for forming the resistive tip body.

Figure 4E:
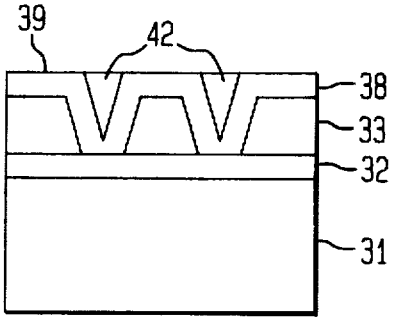

As shown in FIG. 4E the polysilicon on top of the surface will be chemically-mechanically etched back, so that only the molds remain filled with polysilicon 42 and it remains no polysilicon on the surface 39.

Figure 4F:
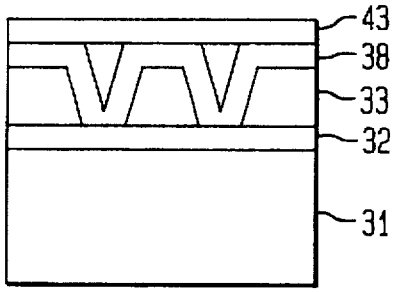

As shown in FIG. 4F the cathode electrode 43 material, for example aluminum, indium-tin oxide or niobium, is now deposited. The required cathode electrode stripes can be realized by deposition through a metal mask, deposition through a lift-off mask or by sputtering the cathode electrode material and subsequent etching using a lithographic process.

Figure 4G:
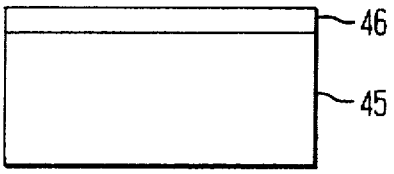

As shown in FIG. 4G a second substrate 45 is prepared which is coated with a bonding layer 46. The bonding layer 46 has to enable the bonding of first and second substrate 31 and 45. The bonding layer 46 may be a metal layer to allow a metal 43 to metal 46 fusing, a low melting glass layer to allow glass sealing or a glue material as for example epoxy or polyimide to allow a glue bonding.

Figure 4H:
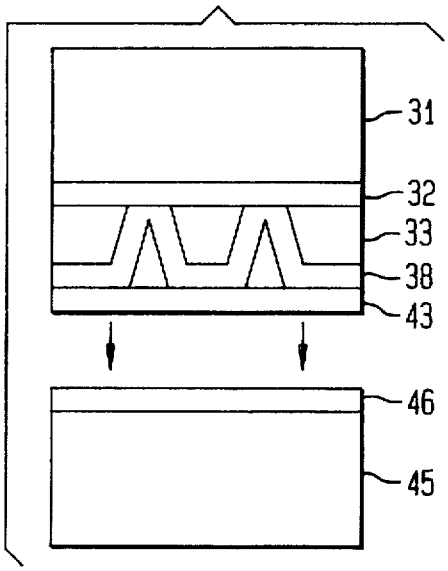
Figure 4I:
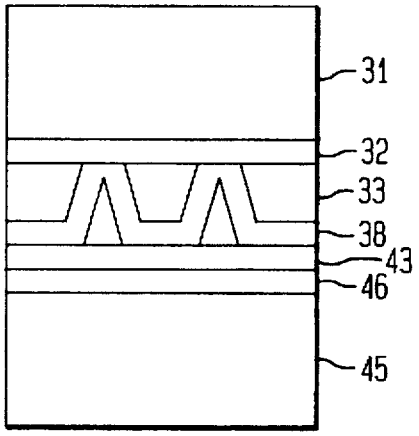

As shown in FIG. 4H the first substrate 31 with its cathode electrode layer 43 is bonded to the second substrate 45 with its bonding layer 46. The arrangement after successful bonding is shown in FIG. 4I.

Figure 4J:
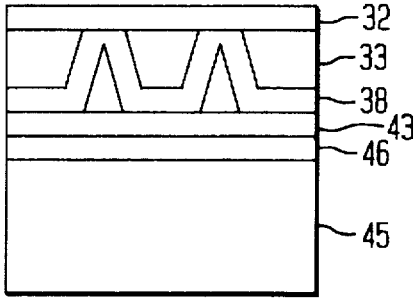

As shown in FIG. 4J the first substrate 31 is removed. If the first substrate 31 is a polycrystalline silicon substrate, it can be dissolved by wet chemical etching. If the first substrate 31 is a glass plate substrate with a dissolvable polymer layer on the top, this layer can be dissolved by laser irradiation. If the first substrate 31 is an aluminum plate, it can be dissolved chemically. If the first substrate 31 is a polymer substrate, it can be dissolved either wet chemically or dissolved in a plasma. Mechanical grinding down to the last few microns of the first substrate material can be applied to all type of substrate materials. The first layer 32 of $Si_3N_4$ acts as an etch-stop either for chemical etching, plasma etching, or chemically-mechanically polishing.

Figure 4K:
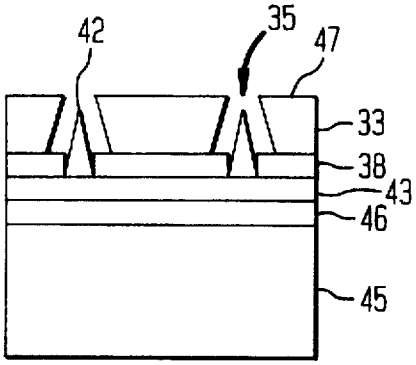

As shown in FIG. 4K the surface 47 of second layer 33 of $SiO_2$, which is now the top surface of the arrangement, defines the geometry and dimension of the gate hole 35. This surface 47 had to be protected during the first substrate 31 removal process. The first layer 32 of $Si_3N_4$ is removed completely on the surface of the arrangement and the third layer 38 of $Si_3N_4$ between the polysilicon tip 42 and the second layer 33 of $SiO_2$ is partially removed, so that the polysilicon tip 42 is released.

Figure 4L:
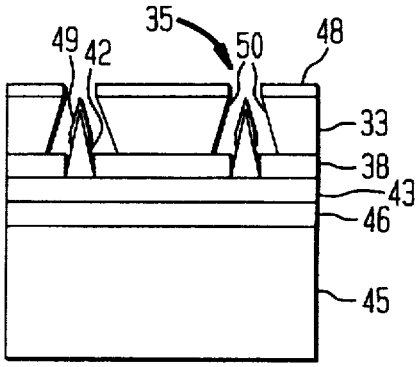

As shown in FIG. 4L a final metal deposition is performed to create the gate electrode 48. This deposition is also performed through a stripped metal mask to create gate electrode stripes which are orthogonal to the cathode electrode stripes 43 but have the same width and distances of the stripes. Simultaneously this final metallization provides the coating 49 of the polysilicon tips 42. Since that tip coating 49 has to provide electron emission, a metal with low work function, e.g. W, Mo, or Al, should be used in this final metallization step. Due to the negative slope 50 of the oxide side walls the gate hole 35 acts as a mask for the tip 42 metal coating 49 and prevents a short-circuit between tip coating 49 and gate electrode 48. The gate hole 35 will be slightly reduced during this metallization process.

We claim:

1. A flat panel display comprising:

a glass face and a substrate hermetically sealed to enclose a vacuumed space therebetween;

an insulating layer;

first and second sets of conductive stripes deposited on opposite sides of the insulating layer with stripes of the two sets orthogonally oriented with respect to each other to form pixel locations at the intersections of the conductive stripes;

a plurality of emissive elements set in cavities in said insulating layer at pixel locations, the tips of said elements each facing the glass face through a hole in a stripe in the second set, said elements each having a molded resistive base portion attached to one of the stripes in the first set and an emissive coating on its tip, wherein the cavities are configured to prevent short circuiting of the emissive coating on the tips to the first set of stripes during application of said emissive coating and said second set of stripes wherein the walls of the cavities have a negative slope so that the cavities are larger near the tips than they are near the electron emitting layer and the cavities have a floor of insulating material into which the resistive base portions of the emissive elements are set;

a bonding layer means bonding the substrate to the metal stripes in the first layer; and a conductive face containing phosphorous elements on the interior surface of the glass face so that the emissive elements form light emitting elements in combination with the phosphorous elements.

2. The flat panel display of claim 1 wherein said second set of stripes and said emissive coating on the tips are the same material applied to the insulating layer and into said cavities onto the tips in a common step.

3. The flat panel display of claim 1 wherein there is a plurality of emissive elements at each intersection which plurality comprises a pixel of said flat display panel.

4. The flat panel display of claim 1 wherein said plurality of emissive elements are arranged in pixel triples where each of the pixel triples comprises at least three emissive elements, one each for the colors red, green and blue.

5. In a field emission device in which emissive tips are each mounted on a stripe in a first set of conductive stripes attached to a substrate and are positioned in cavities of an insulating layer having, on a surface thereof, a second set of conductive stripes orthogonally oriented to the first set of conductive stripes, which second set of conductive stripes have apertures that are located over the cavities at intersections of conductive stripes of said first and second sets, the improvement comprising said tips each having a molded resistive base having thereon an emissive coating of the same material as the second set of stripes, wherein each stripe of the second set of conductive stripes and the emissive coating on the tips in the apertures therein are different, disconnected segments of a layer of conductive material; and wherein said cavities include means for preventing short circuiting of the emissive coatings to the first set of stripes during deposition of the common layers of conductive material making up the stripes of said second set and the emissive coatings, which means for preventing short circuiting of the emissive coatings to the first set of stripes includes a negative slope of the sidewalls of the cavities so that the cavities are larger near the bases of the tips than they are near the electron emitting coating, and wherein said cavities have a floor of insulating material into which the resistive bases of the tips are set.

6. The field emission device of claim 5 including a bonding layer attaching the first set of conductive stripes to the substrate wherein said substrate is glass to thereby provide a glass seal on the substrate to the stripes of the first set.

7. The field emission device of claim 5 including a glass face hermetically sealed to said substrate to form a vacuumed space containing said tips;

a conductive coating on said glass face in the vacuumed space facing said tips; and phosphorous elements on said conductive coating which in combination with the photo-emissive coatings acts as a light emitting source so that the field emission device forms a flat display panel.

8. A flat panel display comprising:

a glass face and a substrate hermetically sealed to enclose a vacuumed space therebetween;

an insulating layer;

first and second sets of conductive stripes deposited on opposite sides of the insulating layer with stripes of the two sets orthogonally oriented with respect to each other to form pixel locations at the intersections of the conductive stripes;

a plurality of emissive elements set in said insulating layer at pixel locations, the tips of said elements each facing the glass face through a hole in a stripe in the second set, said elements each having a tapered resistive base portion attached at its base end to one of the stripes in the first set and an emissive coating on its tip of the same material as the stripes in the second set said emissive elements being set in cavities having means including a floor of insulating material into which the resistive base portions of the emissive elements are set for preventing short circuitry of the emissive coatings to the first set of stripes in a simultaneous deposition of the emissive coating and the second set of stripes; and a conductive face containing phosphorous elements on the interior surface of the glass face so that the emissive tips form light emitting element in combination with the phosphorous elements.

* * * * *